United States Patent [19]

Koza

[11] 4,142,122

[45] Feb. 27, 1979

[54] DISCHARGE LAMP HAVING ARCHED ARC TUBE

[75] Inventor: Francis R. Koza, Salem, N.H.

[73] Assignee: GTE Sylvania Incorporated, Danvers, Mass.

[21] Appl. No.: 847,711

[22] Filed: Nov. 2, 1977

[51] Int. Cl.[2] ..... H01J 61/33

[52] U.S. Cl. ..... 313/220; 313/25; 29/25.13

[58] Field of Search ..... 313/220, 25, 26; 29/25.13

[56] References Cited

U.S. PATENT DOCUMENTS

| | | | |
|---|---|---|---|
| 2,901,648 | 8/1959 | Lindsay et al. | 313/25 |
| 2,904,710 | 9/1959 | Beeninga et al. | 313/25 |
| 3,858,078 | 12/1974 | Koury | 313/220 |

*Primary Examiner*—Rudolph V. Rolinec
*Assistant Examiner*—Darwin R. Hostetter
*Attorney, Agent, or Firm*—James Theodosopoulos

[57] ABSTRACT

A metal halide arc discharge lamp has an elongated outer envelope within which is disposed an arched arc tube, the position of the arc tube being transverse to the axis of the envelope.

2 Claims, 3 Drawing Figures

DISCHARGE LAMP HAVING ARCHED ARC TUBE

THE INVENTION

This invention relates to metal halide arc discharge lamps. It is particularly concerned with such lamps in which the arc tube is arched, as shown in U.S. Pat. No. 3,858,078, the disclosure of which is incorporated herein by reference. In that patent, the arc tube and outer envelope are both positioned for horizontal mounting.

In some cases it is desirable to use an arched arc tube in an outer envelope which is mounted vertically. Since the arc tube must be operated horizontally, a problem results in inserting the arc tube and its mounting frame into the envelope prior to sealing, since the arc tube length is greater than the diameter of the neck of the open envelope. It is the purpose of this invention to provide a solution to the problem.

In a lamp in accordance with this invention, the arc tube is pivotally spring mounted on the frame. The at-rest position of the arc tube is horizontal when the frame is vertical. At the time of insertion of the arc tube and mount into the open end of the envelope, the arc tube is rotated on the mount and held in that position until it is within the envelope. The arc tube is then released and the springs rotate the arc tube about 90° to the horizontal position. The normal operating position of the arc tube is horizontal, arch uppermost, when the envelope is vertically mounted, base up.

Figure 1:
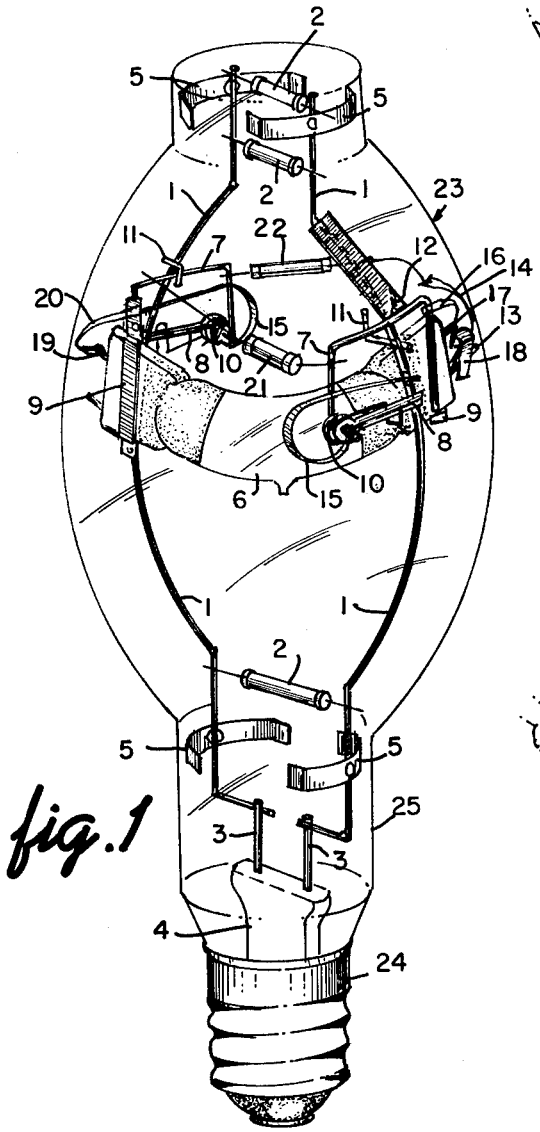
FIG. 1 shows a finished lamp with the arc tube in the normal operating position.
Figure 2:
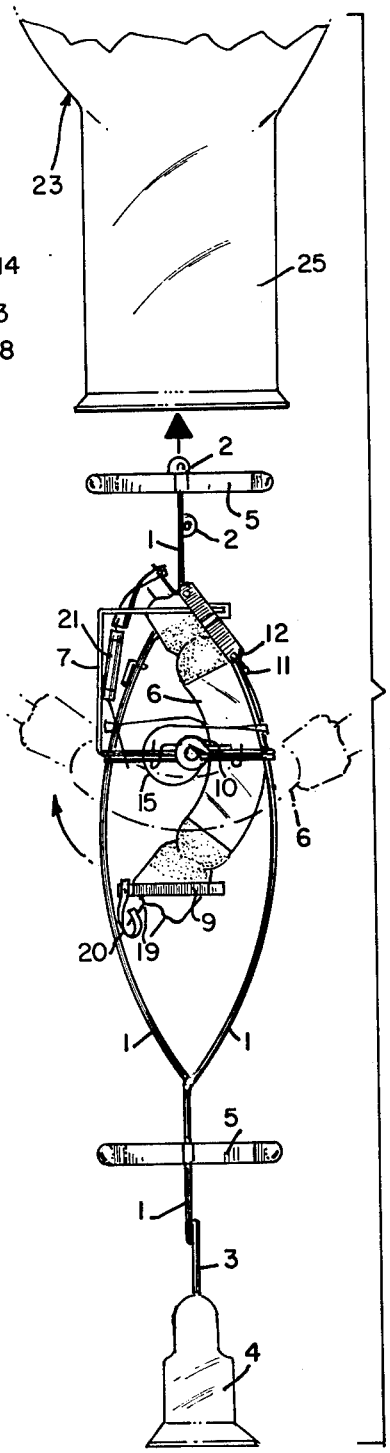
FIG. 2 shows an arc tube mounted on a frame and rotated for insertion into a lamp envelope.
Figure 3:
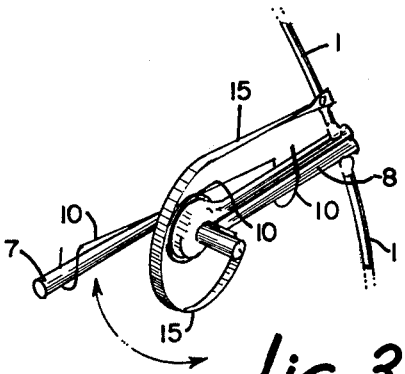
FIG. 3 shows, in greater detail, the spring mount for the arc tube.

As shown in one embodiment in the drawing, a mount for a lamp in accordance with this invention comprises a two piece elongated metal main frame 1 supported by three insulators 2 across the two frame pieces. Frame 1 is connected to two external in-lead wires 3 which are embedded in glass stem flare mount 4. Four bulb spacers 5 are mounted on main frame 1 and will support the assembly within envelope 23 by pressing on the inside walls thereof. Arched arc tube 6 is supported by two curved pivot frames 7 and two pivot rods 8 as will be described. Each end of arc tube 6 has a strap 9 attached thereto. For each end of arc tube 6, one end of pivot frame 7 is attached to strap 9 and the other end of pivot frame 7 is rotatably supported in a hole at one end of pivot rod 8. The other end of rod 8 is attached to frame 1. This arrangement permits arc tube 6 to rotate in a vertical plane when the frame is in a vertical position.

There is a torsion spring 10 encircling the rotatably supported end of pivot frame 7, one leg of torsion spring 10 bearing against pivot rod 8 and; the other leg of torsion spring 10 bearing against pivot frame 7. Torsion springs 10 are arranged to restore arc tube 6 to the horizontal position after insertion of the rotated arc tube into envelope 23 and release of the rotating force. Pivot guides 11 are fastened to frame 1 and aid in positioning arc tube 6 in the proper horizontal position, while a spring latch 12 in combination with one of the pivot guides 11 latches the arc tube in said position.

The electrical connections for arc tube 6 are as follows. Arc tube wire 13, which is connected to the starter electrode (not shown) within arc tube 6, is connected to nickel ribbon 14, which is connected to resistor 22 and, in turn, to one pivot frame 7, nickel ribbon coil 15, one side of frame 1 and one in-lead wire 3. Arc tube wire 17, which is connected to the main electrode (not shown) adjacent the starter electrode within arc tube 6, is connected to, in turn, nickel ribbon 16, the other pivot frame 7, nickel ribbon coil 15, the other side of frame 1 and the other in-lead wire 3. Bimetal switch 18 is welded to arc tube wire 17 and makes contact with arc tube wire 13 when heated, in order to place said electrodes at the same potential during operation.

At the opposite end of arc tube 6, arc tube wire 19, which is connected to the main electrode (not shown) within arc tube 6, is connected through nickel ribbon 20 to the same pivot frame 7 as the starter electrode. Item 21 is connected between the two pivot frames 7 and is a counterweight added to compensate for resistor 22.

In producing a metal halide lamp of the type where the axis of arc tube 6 (disregarding the arch) is substantially in alignment with the axis of envelope 23, the mount (which includes everything except envelope 23 and base 24) is preassembled, and the open envelopes are conveyor fed to a sealing machine. At a loading station prior to the sealing machine, an operator picks up a mount, removes an envelope from the conveyor, inserts the mount in the envelope and replaces it on the conveyor, which brings the loaded envelope to the sealing machine.

In the manufacture of lamps in accordance with this invention, that is, where the axis of arc tube 6 (disregarding the arch) is substantially transverse to the axis of envelope 23, an operator picks up a mount, rotates arc tube 6 to the vertical position, holds the arc tube so positioned with a finger, removes an open envelope from the conveyor, inserts the mount into the envelope releasing the arc tube as it enters the neck of the envelope, and replaces the loaded envelope on the conveyor.

As the mount is inserted into the open envelope, the axis of arc tube 6 remains aligned with the axis of envelope 23 until arc tube 6 passes through neck 25. Once past neck 25, the spring loaded arc tube pivoting assembly rotates arc tube 6 to a position transverse to the axis of envelope 23, where it is stopped by pivot guides 11. At the same time spring latch 12 snaps into place, locking arc tube 6 into that position.

I claim:

1. In a metal halide arc discharge lamp of the type comprising an arched arc tube disposed within an elongated outer envelope having a cylindrical neck portion, the length of the arc tube being greater than the diameter of the neck portion, the improvement which comprises the arched arc tube being transverse to the axis of the outer envelope, the arc tube being rotatably supported on an elongated frame, a latch on said frame latching the arc tube in said transverse position, and torsion springs on said frame which act to restore the arc tube to said transverse position when the arc tube is rotated away from said transverse position.

2. A metal halide arc discharge lamp comprising: an elongated outer envelope including a cylindrical neck portion; an arched arc tube transversely disposed within said envelope, the length of the arc tube being greater than the diameter of said neck portion; the arc tube being supported on a frame comprising two elongated frame pieces having insulator supports between them; each frame piece having a pivot rod attached thereto, each pivot rod rotatably supporting one end of a pivot frame, the arc tube being supported between the other ends of the two pivot frames; and torsion springs on said frame acting to maintain the arc tube in a transverse position and to restore the arc tube to said transverse position when it is rotated away therefrom.

* * * * *